United States Patent [19]

Nguyen

[11] 4,439,272

[45] Mar. 27, 1984

[54] PULP MILL RESIDUAL LIQUOR RECOVERY PROCESS

[76] Inventor: Xuan T. Nguyen, 7375 Maynard, Montreal, Quebec, Canada

[21] Appl. No.: 339,114

[22] Filed: Jan. 13, 1982

[51] Int. Cl.[3] ..... D21C 11/04

[52] U.S. Cl. ..... 162/30.11; 423/207

[58] Field of Search ..... 162/30.1, 30.11; 423/207, DIG. 3

[56] References Cited

U.S. PATENT DOCUMENTS

| | | | |
|---|---|---|---|
| 3,309,262 | 3/1967 | Copeland et al. | 162/30.11 |
| 3,323,858 | 6/1967 | Guerrieri | 423/DIG. 3 |
| 3,761,568 | 9/1973 | Brink et al. | 423/DIG. 3 |
| 4,135,968 | 1/1979 | Dehaas | 162/30.1 |
| 4,303,469 | 12/1981 | Di Novo et al. | 162/30.1 |

*Primary Examiner*—Peter F. Kratz

[57] ABSTRACT

A method and apparatus for recovering chemical from residual liquor from a pulping operation, said residual liquor containing inorganic and organic components, pyrolyzing a portion of the organics in the liquor to produce a reducing gas and residual solids containing said inorganic component and the remainder of said organics, said reducing gas containing sulfur compounds, oxidizing the remainder of the organics and recombining the sulfur contained in said reducing gas with said inorganic components to produce suflur compounds and reducing said sulfur compounds with said reducing gas.

4 Claims, 2 Drawing Figures

PULP MILL RESIDUAL LIQUOR RECOVERY PROCESS

FIELD OF THE INVENTION

The present invention relates to a recovery system for kraft pulping process. More particularly, the present invention relates to an improved recovery system wherein at least a portion of the black liquor is pyrolized to produce a reducing gas, the pyrolized solids oxidized to provide oxidized inorganic solids and the gas generated during pyrolizing used to reduce the oxidized inorganic solids.

BACKGROUND TO THE INVENTION

As taught in U.S. Pat. No. 4,011,129 issued Mar. 8, 1977 to Tomlinson, it is known to burn a portion of the black liquor from the kraft pulping in a fluidized bed oxidation zone and to direct the pellets formed during this fluidized bed oxidation onto the surface of the char bed in a conventional kraft recovery boiler and there to reduce the sodium sulfate in the pellets to sodium sulfide. This process has proved quite satisfactory and is currently being practiced at Domtar's Fine Paper Mill in Cornwall, Ontario. The reduction efficiency of the furnace has been found to have been, to some extent, adversely affected by the additional load applied thereto through the application of pellets on to the bed.

It is also well known to pyrolize a residual pulping liquor and subsequently burn the gas generated while simultaneously burning the remainder of the organics in the liquor, thereby to generate sodium carbonate pellets and to subsequently contact the sodium carbonate pellets with $SO_2$ derived from the burning of the remainder of the gas from the pyrolizer to form sodium sulfate (see Canadian Pat. No. 960,811, issued Jan. 14, 1975 to Shick).

It has also been proposed in U.S. Pat. No. 4,135,968 issued Jan. 23, 1979, to Dehass, to dry a portion of the black liquor from a kraft mill, pyrolyze same and add the dry pyrolyzed solids to the remainder of the black liquor for injection into the recovery furnace whereby the inorganics in the pyrolyzed solids as well as in the remainder of the liquor are reduced in the recovery furnace. The gas from the pyrolyzer will generally be treated for sulfur removal and then burned in a separate unit.

In another arrangement dry residual liquor solids are pyrolized to produce a combustion or fuel gas from about 70% of the organics present in the dried liquor and the remaining organics and the inorganics are treated in a molten salt bath gasifier to produce further fuel gas and a smelt. The gasifier may be operated under reducing conditions so that the smelt when dissolved provides a green liquor. The fuel gases produced in the pyrolizer and the gasifier may be burned to generate steam in a boiler.

BRIEF DESCRIPTION OF PRESENT INVENTION

It is the object of the present invention to provide a process for recovering residual liquor from a kraft pulping operation.

Broadly the present invention relates to a process for the recovery of chemical from residual liquor resulting from a pulping cellulosic material comprising pyrolyzing at least a portion of the residual liquor to provide a reducing gas and residual solids containing inorganic and organic material, said reducing gas containing sulfur compounds, oxidizing the organic material in said solids, and recombining said sulfur in said reducing gas with said oxidized inorganics to produce other type of sulfur compounds and reducing said other type of sulfur compounds with said reducing gas. Recombining may be performed either in the oxidation stage or the reducing stage or both.

BRIEF DESCRIPTION OF THE DRAWINGS

Further features, objects and advantages will be evident with the following detailed description of the preferred embodiments of the present invention taken in conjunction with the accompanying drawings in which.

DESCRIPTION OF THE PREFERRED EMBODIMENTS OF THE INVENTION

Figure 1:
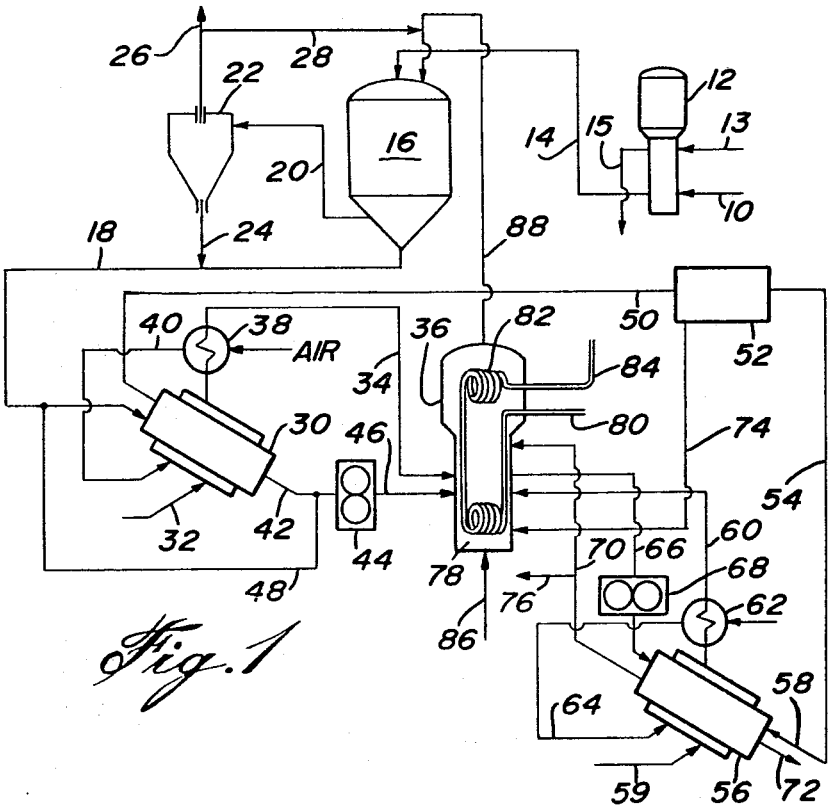
FIG. 1 is a schematic illustration of one form of the invention.

As illustrated, the oxidized black liquor say, about 15% solids enters the system via line 10 and passes through a set of multiple effective evaporators 12 (only one shown) and is concentrated say, to about 50% solids leaving the system via line 14. Steam enters the evaporator via line 13 and condensate leaves via line 15.

The concentrated liquor in line 14 may be delivered into a spray dryer or the like 16 where it is dried and leaves as a coarse powder via line 18. The fines leaving the system via line 20 are separated from the gas stream in the cyclone 22 and pass via line 24 to line 18. Gases are removed from the cyclone 22 via line 26 and some may be recycled via line 28 back into the dryer 16.

Alternatively, the black liquor may simply be concentrated to the desired degree in the evaporators 12 and the liquor in line 14 pyrolized under pressure in the presence of water to provide a reducing gas and residual liquor solids containing both organic and inorganic components as will be described herein below.

The powder liquor solids in line 18 passes into a pyrolyzer generally indicated at 30. During start up, fuel such as natural gas or the like enters via line 32 and the exhaust gases pass via line 34 into a fluidized bed boiler system 36. The air entering the pyrolyzer 30 passes through heat exchanger 38 to absorb heat from the exhaust gases in line 34 and then via line 40 into the pyrolyzer to provide oxygen for combustion of a natural gas or other fuel. In operation the heat necessary to operate the pyrolizer will normally b derived from the organics in the liquor.

The pyrolized solids containing some of the organics, generally about 50% to 80% and normally about 70% of the organic originally in the liquor pass via line 42 to a pelletizer or the like 44 (if the particle size is so small that it would otherwise simply carry out in the gas stream from the fluid bed) and are injected via line 46 into the fluid bed 36 where the organic components are burned and the inorganics accumulated in the form of pellets. Some of the pyrolized powder may be recirculated to the pyrolizer 30 via line 48. These pyrolized solids are relatively hot and are mixed to the powdered liquor solids from line 18 to heat the liquor solids preferably to the temperature at which pyrolizing may commence.

Reducing gas leaves the pyrolizer via line 50 and may be treated in a variety of different ways depending on the specific system to be employed and depending on the manner in which the pyrolizer is operated. For example the gasses may pass into a unit generally indicated at 52 which may either be a sulfur separation unit or a sulfur oxidation unit or the unit may be completely by-passed. These alternatives will be discussed herein below.

The fluidized bed 36 in the illustrated arrangement preferably is provided with a heat exchanger generally indicated at 78. In the illustrated arrangement the water or steam enters via line 80, passes through the heat exchanger 78 which is shown in the bed and through a second heat exchanger 82 mounted in the freeboard area and steam leaves the system via 84. Alternatively fluid to be heated (steam or water) may flow in the opposite direction, it being important to absorb heat from the combustion or oxidation occuring in the fluidized bed 36 to ensure the bed is not overheated. The bed temperature may be controlled by adding water but the use of indirect heat exchange improves the thermal efficiency of the system. As will be apparent fluidizing air is introduced into the bed via the line 86 and oxidizes the organic materials entering the bed via the line 46 as a part of the pyrolyzed solids. Gaseous fuel may also be injected into the unit via line 70 either into the bed (if sufficient heat exchange surface is available) or into the freeboard and burned to generate heat which will be recovered in the boiler 78 and 82. Flue gases leave the fluidized bed 36 via line 88 and pass into the spray dryer 16 to dry the liquor entering this dryer in the FIG. 1 embodiment.

As above indicated the solids entering the fluidized bed via line 46 form pellts of sodium carbonate and sodium sulfate. These pellets as described above may be crushed in the crusher 68 to a smaller particle size and then introduced into the reducer 56. Crushing reduces the time required for reduction i.e. the smaller the particle size the less time required for reduction. It has been found that if the particle size is too large the reducing action is impaired, therefore, in some cases the particle size may require reduction, however, the size range of the pellets normally extracted from the fluid bed (generally about 200–2000 microns range and an average of about 800 microns) are quite satisfactory.

Figure 2:
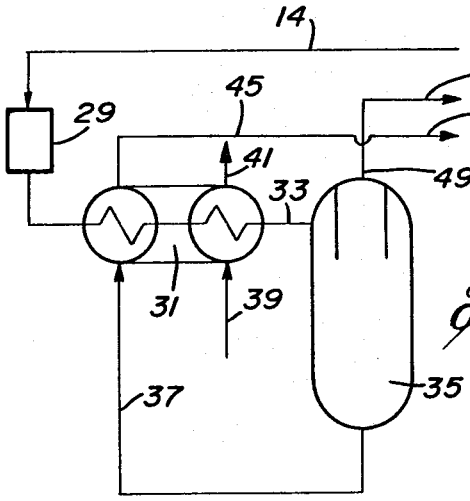
FIG. 2 schematically illustrates a modified pyrolyzer system for incorporation into the present invention.

While it is preferred to use the dry method i.e. spray dryer 16 etc. and to pyrolize dry solids, it is also possible to take the liquor from the line 14 (at said 50% solids) as illustrated in FIG. 2, to pressurize same with a pressurizing pump 29 and feed the liquor through a pressurized heater 31 heated by any suitable means and carry the heated liquor via the line 33 to a separator 35 where the reducing gas produced is separated and leaves via line 49 which connects to line 50 in FIG. 1 for use in any of the three embodiments described hereinbelow.

The pyrolyzed liquor solids remaining after separation of the reducing gas passes via line 37 back to the heater 31 where heat is extracted and used to heat the liquor entering from line 14. The pyrolized solids together with any liquid (water) accompanying same passes from the heater 31 via line 45 to line 46 shown in FIG. 1 for injection into the fluidized bed 36. Any further heat required for pyrolizing may be added in the heater 31 by suitable means as indicated by the arrow 39 and the waste heat recovered, if desired, from line 41.

Either the FIG. 1 or FIG. 2 pyrolizing configuration may be used with the first, second and third embodiments of the invention to be described herein below, but means may be required to treat the flue gases from the fluidized bed to ensure that sulfur losses are maintained with acceptable limits if the wet technique of FIG. 2 is used since the direct contacting of the liquor with the flue gas may not be used.

In either of the FIG. 1 or FIG. 2 arrangements, the amount of inorganics pyrolized will be at least sufficient to generate sufficient reducing gas to reduce the material (inorganic solids from the residual liquor) in the reducer 56. Generally just enough reducing gas will be generated to reduce the material unless the requirement for fuel gas is significantly higher than the reducing gas requirements, but the sulfur content of the gas must be recovered.

FIRST EMBODIMENT

If the unit 52 is bypassed the reducing gasses will pass directly via lines 54 and 58 into a reducer 56 which may be heated e.g. by fuel gas fed in line 59 or by a portion of the reducing gas line 54 directed to line 59 through a line not shown. The exhaust heating gases from the reducer pass via line 60 into the fluidized bed 36, while incoming air passes in exchange with the air in line 60 in the heat exchanger 62 and via line 64 to form combustion air for the gas entering via line 59.

Pellets formed in the fluidized bed 36 are removed from the bed, pass via line 66 and, if desired a crusher 68 into the reducer 56 where the sulfur components ($Na_2SO_4$) are reduced by the gasses entering via lines 54 and 58. Gasses from the reducer pass via line 70 into the fluidized bed 36 for combustion and adsorption of the $SO_2$ by the inorganics forming the pellets and the reduced pellets leave the reducer via line 72.

It is normally preferred to introduce these gases from the reducer into the bed i.e. directly into the fluidized bed portion where they are oxidized since these gases may contain sulfur compound that react with the material in the bed thereby to prevent escape of $SO_2$ and to retain the sulfur in the system. However, it is imperative that the bed temperature not exceed a certain maximum temperature level and if there is not adequate heat exchange available in the bed it may be necessary to introduce and burn this gas in the freeboard area where the sulfur compounds will combine with dust and the heat generated absorbed in the boiler section. Any $SO_2$ so formed and not reacted with the dust can be scrubbed from the flue gas using, for example, the drier 16 or other suitable means (not shown) such as means for direct contact absorption by the black liquor from line 14.

SECOND EMBODIMENT

In an alternate arrangement the gasses leaving the pyrolizer in line 50 and containing sulfur compounds may be passed through the unit 52 which is a sulfur separator adapted to separate the reducing gas from $SO_2$ and passes it into the reducer 56 via line 58 to reduce the pellets entering the reducer 56 via line 66. The resultant reducing gases are now free of sulfur and thus may be either fed directly back to the fluidized bed as indicated via line 70 or alternatively can be passed via line 76 to form a fuel for any suitable application e.g. a calciner, power boiler, etc. The $SO_2$ gases separated in the unit 52 pass via line 74 into the fluid bed 36 and are absorbed by the inorganics in the bed 36 or in the drier 16 or in both.

The unit 52 of the above identified arrangement may provide for catalytic oxidation and the adsorbtion of $H_2S$ and TRS emissions from the pyrolizer using the following chemical reaction in one reactor.

$$\text{TRS or } H_2S + Fe_2O_3 \rightarrow Fe_2S_3 + H_2O \quad (1)$$

Sulfur is then desorbed from the iron to regenerate ferric oxide in a second reactor according to the following equation.

$$Fe_2S_3 + O_2(\text{air}) \rightarrow SO_2 + Fe_2O_3 \quad (2)$$

The sulfur dioxide then passes via line 74 as above described into the fluidized bed 36 or some other suitable means where it contacts with the inorganics of the pulping liquor and is captured. These inorganics will include sodium sulfate and sodium carbonate. A portion of the later will react with the $SO_2$ at the operating temperature in the fluidized bed of about 1250° F. to form sodium sulfate according to the following equation:

$$SO_2 + Na_2CO_3 \rightarrow Na_2SO_4 + CO_2 \quad (3)$$

Finally the sodium sulfate is reduced in the reducer 56 in accordance with the following reaction:

$$Na_2SO_4 + H_2/CO \rightarrow Na_2S + H_2O + CO_2 \quad (4)$$

THIRD EMBODIMENT

Alternatively unit 52 may function as a catalytic oxidation unit converting the $H_2S$ or TRS in the gasses leaving the pyrolizer as follows.

$$\text{TRS or } H_2S + O_2 \xrightarrow[\text{carbon, bauxite}]{\text{catalyst eg. activated}} SO_2 + \text{heat} \quad (5)$$

The reducing gas now containing sulfur dioxide so generated may then be passed directly to the reducing zone via the line 58 to react with the pellets from the fluidized bed in particular the sodium carbonate in the pellets from the bed 36 as follows.

$$SO_2 + Na_2CO_3 \rightarrow Na_2SO_4 + CO_2 \quad (6)$$

The sodium sulfate formed by the above reaction as well as any sodium sulfate in the pellets from the fluid bed 36 further react under the reducing conditions in the reducer 56 as follows:

$$Na_2SO_4 + H_2/CO \rightarrow Na_2S + H_2O/CO_2 \quad (7)$$

The gasses leaving the reducer pass via line 70 back to the fluidized bed either directly into the bed or into the freeboard. Burning these gases in the freeboard does not require as stringent $SO_2$ recovery as with the first embodiment since the amount of $SO_2$ in the gas is relatively small. Alternatively these gas may be directed via line 76 used in another suitable combustor since their sulfur content will be quite low.

EXAMPLE

Various test were conducted in the lab to prove the operability of the steps of the present invention.

1. Hardwood kraft pulping liquor was dried in a pilot plant scale co-current spray drying system having a cross-sectional area and chamber height of about 1.0 $ft^2$ and 8 ft respectively. Hot air was used as a drying gas and typical results obtained were as follows:

| Inlet | | Outlet | Black Liquor Inlet | | | Residual |
|---|---|---|---|---|---|---|
| flow (SCFM) | temp. (°C.) | Temp. (°F.) | Flow Imp. Gal./hr. | Temp. (°C.) | Solids (%) | Liquor Powder Moisture (%) |
| 126–135 | 218–233 | 113–127 | 3.4 | 89–92 | 48.2 | 1.1–2.3 |
| 101–103 | 188 | 101 | 2.4 | 90 | 54.7 | 4.0 |

2. The burning of kraft pulping liquor produces pellets containing approximately 32% $Na_2SO_4$ by weight or 15.1 lb $Na_2SO_4$/100 lb black liquor solids. To obtain a complete $Na_2SO_4/a_2S$ conversion, assuming the following reduction reactions:

$$Na_2SO_4 + 4H_2 \rightarrow Na_2S + 4H_2O \quad (1)$$

$$Na_2SO_4 + 4CO \rightarrow Na_2S + 4CO \quad (2)$$

A stoichiometric requirement of four moles of $H_2$ or CO per mole of $Na_2SO_4$, corresponding to 0.42 lb moles reducing gas per 100 lb black liquor solids, would be required. Literature data indicated that for each 100 lb black liquor solids, the pyrolysis of kraft liquor at about 700° C. produced a non-condensible gas mixture with about 1.0 lb moles $H_2$ 0.15 lb moles CO, 0.10 lb moles $CH_4$ and 0.40 lb moles of $CO_2$. Obviously if the above gas mixture is the source of reducing gases, the completion of reactions (1) and/or (2) still leaves about 0.68 moles of $H_2$ and CO per 100 lb black liquor solids present in the spent reducing gas stream, i.e. more than 100% in excess of the stoichiometric requirement. Since the reducing process is not 100% efficient it will normally be necessary to provide at least a slight excess of such gas over and above the stochiometric requirements.

3. Inorganic pellets, formed from oxidation of spent hardwood kraft pulping liquor in a fluidized bed type combustion unit, and containing about 67% sodium carbonate and 33% sodium sulfate were reduced in the solid state using $CH_4$, CO or $H_2$ which are known to be the principal vapour products of pyrolysis of spent kraft pulping liquor. The following sulfate reduction results were obtained:

| Reducing Gas Stream(3) | | Pellet | Reducing | Sulfate Reduction Effic.(1) |
|---|---|---|---|---|
| Type | Temp. (°C.) | Size (Microns) | Duration (hrs) | (%) |
| $CH_4$ | 680 | 254 | 5.0 | 24.7 |
| $CH_4$ | 680 | 421 | 2.5 | 13.4 |
| CO | 620 | 254 | 1.0 | 42.3 |
| CO | 620 | 254 | 3.0 | 66.4 |
| $H_2$ | 620 | 254 | 2.0 | 74.4 |
| $H_2$ | 620 | 254 | 2.5 | 83.2 |
| $H_2$ | 620 | 421 | 2.5 | 63.8 |
| $H_2$ | 620 | 635 | 2.5 | 55.6 |
| $H_2$ | 620 | 1060 | 1.0 | 24.2 |
| $H_2$ | 620 | 1060 | 2.5 | 41.4 |
| $H_2$ | 620 | 1060 | 5.0 | 83.3 |
| 50% $H_2$ in Nitrogen | 620 | 254 | 2.0 | 71.2 |
| 25% $H_2$ and 25% CO in Nitrogen | 620 | 254 | 2.0 | 61.8 |

(1)(moles $Na_2S$ formed/initial moles $Na_2SO_4$ in pellet)
(2)Temperature at the wall of the tube furnace (1.0" ID × 13" length)
(3)Flow 0.3–0.5 l/min 4. Based on the above table and literature indications that the composition of the non-condensible reducing gas produced by the pyrolysis of a spent kraft pulping liquor would contain about 60% $H_2$, 10% $CO_2$ and 6% $CH_4$ and a typical mean pellet size from the fluid bed of about 800 microns it was estimated that to obtain about 90% overall sulfate reduction, would require a total reducing time of about 6–10 hrs at a temperature of 620° to 650° C.

Having described the invention, modifications will be evident to those skilled in the art without departing from the spirit of the invention as defined in the appended claims.

I claim:

1. A method for the recovery of chemical from residual liquor resulting from kraft pulping of cellulosic material which sequentially comprises:

(a) initially feeding all of the residual liquor to a first reaction zone and in the first reaction zone pyrolyzing the residual liquor to produce a reducing gas containing sulfur compounds and residual materials consisting of inorganic and organic components, with the proviso that said residual materials are in a solid or in a liquor of solid state, (b) in a second reaction zone oxidizing in a fluidized bed provided therein with an internal heat extraction system said residual materials from the first reaction zone as to burn substantially all of said organic component and to accumulate said inorganic component as inorganic solids within said bed, said solids comprising at least a portion of sodium carbonate and sodium sulfate, (c) thereafter in a third reaction zone reducing said inorganic solids in solid phase with said reducing gas of said first reaction zone said residual liquor from said first reaction zone being sufficient to generate the amount of said reducing gas required for reducing in said third reaction zone said inorganic solids combined with said sulfur compounds and removing reduced inorganic solids comprising sodium carbonate and sodium sulfide from said third reaction zone, (d) directing the spent reducing gas containing sulfur compounds from said third reaction zone into said second reaction zone to convert said sulfur compounds of said reducing gas into sulfur dioxide gas and combining said sulfur dioxide gas with said inorganic solids in step b, and thereby at least partly to convert said sodium carbonate into sodium sulfate.

2. A method as defined in claim 1 wherein a portion of said sulfur compounds from said pyrolyzing is separated from said reducing gas and converted into sulfur dioxide, and then fed into at least one of said second and third zone to be (being) combined with said sodium carbonate portion.

3. A method as defined in claim 1 wherein said residual materials oxidized in said fluidized bed form pellets comprising predominantly sodium carbonate and sodium sulfate, said pellets being passed to said third zone and wherein in said third zone, said sodium sulfate contained in said pellets is reduced to sodium sulfide.

4. A method as defined in claims 1 or 3, wherein at least a major portion of said sulfur compounds from said pyrolyzing is fed to said third zone.

* * * * *